United States Patent [19]

Simmons

[11] 4,170,537

[45] Oct. 9, 1979

[54] METHOD OF PREPARING A DIAPHRAGM HAVING A GEL OF A HYDROUS OXIDE OF ZIRCONIUM IN A POROUS MATRIX

[75] Inventor: Robert B. Simmons, Norton, Ohio

[73] Assignee: PPG Industries, Inc., Pittsburgh, Pa.

[21] Appl. No.: 953,134

[22] Filed: Oct. 20, 1978

[51] Int. Cl.[2] ..... C25B 13/00; C25B 13/04; C25B 13/06; C25B 13/08

[52] U.S. Cl. ..... 204/295; 204/296; 521/27

[58] Field of Search ..... 204/295, 98, 296, 301, 204/252, 253; 521/27, 28

[56] References Cited

U.S. PATENT DOCUMENTS

| | | | |
|---|---|---|---|
| 1,942,183 | 1/1934 | Muller | 204/28 |
| 2,661,288 | 12/1953 | Barbaras | 92/21 |
| 3,056,647 | 10/1962 | Amphlett | 23/14.5 |
| 3,479,266 | 11/1969 | Rajan et al. | 204/295 X |
| 3,479,267 | 11/1969 | Rajan et al. | 204/295 X |
| 3,541,030 | 11/1970 | Boies et al. | 521/27 |
| 3,702,267 | 11/1972 | Grot | 204/295 X |
| 3,703,413 | 11/1972 | Arrance | 136/6 |
| 4,032,427 | 6/1977 | Kadija | 204/295 X |
| 4,089,758 | 5/1978 | McAloon | 204/98 |
| 4,120,772 | 10/1978 | Kadija | 204/295 X |

*Primary Examiner*—Arthur C. Prescott
*Attorney, Agent, or Firm*—Richard M. Goldman

[57] ABSTRACT

Disclosed is a method of preparing a hydrous zirconium oxide diaphragm by treating a porous matrix with $ZrOCl_2$ and hydrolyzing the $ZrOCl_2$ to $ZrO_2$ with $NH_3$. The disclosed method contemplates leaching out the $NH_4Cl$, dehydrating the substrate, and sequentially building up the $ZrO_2$.

7 Claims, No Drawings

METHOD OF PREPARING A DIAPHRAGM HAVING A GEL OF A HYDROUS OXIDE OF ZIRCONIUM IN A POROUS MATRIX

Alkali metal chloride brines, such as potassium chloride brines and sodium chloride brines, may be electrolyzed in a diaphragm cell to yield chlorine, hydrogen, and aqueous alkali metal hydroxide. In a diaphragm cell, brine is fed to the anolyte compartment and chlorine is evolved at the anode. Electrolyte from the anolyte compartment percolates through an electrolyte permeable diaphragm to the catholyte compartment where hydroxyl ions and hydrogen gas are evolved.

Previously, the diaphragm has been provided by fibrous asbestos deposited on an electrolyte permeable cathode. However, environmental and economic considerations now dictate a more longer-lived, less environmentally threatening diaphragm. It is, therefore, necessary to provide either a synthetic polymer diaphragm, a porous ceramic diaphragm, a non-asbestos inorganic fiber matrix, or a modified asbestos diaphragm between the anolyte compartment and the catholyte compartment of the cell.

One particularly satisfactory diaphragm is a diaphragm having a porous matrix, e.g., a polymeric, ceramic, or asbestos matrix, with a hydrous oxide of zirconium contained within the matrix. As herein contemplated the diaphragm may be prepared by contacting and preferably saturating a porous matrix with a zirconium compound, whereby to preferably fill the porous matrix with the zirconium compound, converting the zirconium compound to an oxide, for example, by hydrolysis, and thereafter removing the by-products of the hydrolysis.

More particularly, there is contemplated a method of preparing a diaphragm having a contained volume surface of a hydrous oxide of zirconium by depositing zirconyl chloride solution in a porous matrix, hydrolyzing the zirconyl chloride with ammonia to the hydrous oxide of zirconium, leaching out the ammonium chloride formed thereby, dehydrating the matrix contained hydrous oxide, and thereafter sequentially forming additional hydrous oxide of zirconium.

DETAILED DESCRIPTION OF THE INVENTION

The diaphragm is characterized by a porous matrix with a volume of a hydrous oxide of zirconium contained in the matrix void volume. The matrix is substantially inert to the electrolyte. Suitable materials of construction include asbestos fibers, and fluorocarbon polymers, and ceramics, e.g., ceramic fibers, ceramic particles and cast porous ceramics. The fluorocarbon polymers useful in providing the substrate are perfluorinated polymers such as polyperfluoroethylene, polyperfluoroalkoxys, and polyperfluoroethylene-propylene, fluorinated polymers such as polyvinylidene fluoride and polyvinyl fluoride, and chlorofluorocarbon polymers such as chlorotrifluoroethylene and the like. Especially preferred are the perfluorinated polymers. As used herein, the term fluorocarbon polymers also encompasses those fluorocarbon polymers having active groups thereon, e.g., fluorocarbon polymers having sulfonic acid groups, sulfonamide groups, and carboxylic acid groups, inter alia. Additionally, the fluorocarbon polymer may have a coating, layer, or film of a fluorocarbon resin having pendant active sites thereon.

The film may be provided by treating the matrix with a suitable perfluorinated resin having pendant sulfonic acid groups, pendant sulfonamide groups, pendant carboxylic acid groups, or derivatives thereof.

The matrix may be fibrous, e.g., either woven fibers or nonwoven fibers such as felts. The felts may be formed by deposition, for example, by filtration type processes, or by needle punch felting processes. Alternatively, the porous matrix may be in the form of a sheet or film. The sheet or film may be rendered porous as described, for example, in British Pat. No. 1,355,373 to W. L. Gore and Associates for *Porous Materials Derived From Tetrafluoroethylene and Process For Their Production,* or as exemplified by Glasrock "Porex" brand polytetrafluoroethylene films.

The porous sheet or film should have a thickness of from about 10 to about 50 mils with pores of from about 0.8 to about 50 micrometers in diameter and preferably from about 2 to about 25 micrometers in diameter. The porosity of the porous sheet or film should be from about 30 to about 90 percent.

The thickness of the porous felt should be from about 0.04 to about 0.2 inch and preferably about 0.05 to 0.15 inch. The porosity of the porous felt should be from about 30 to about 90 percent.

The substrate surface has a film or layer of a hydrous oxide of zirconia, i.e., a gel of zirconia. The zirconia gel is believed to have the chemical formula $ZrO_2 \times nH_2O$ and is characterized as a hydrous zirconia gel. "n" is generally from about 2 to about 4. Low loadings of zirconia alone, e.g., below about 0.1 gram per cubic centimeter, result in a diaphragm that is high in permeability and low in current efficiency. Intermediate loadings of zirconia alone, that is, from about 0.1 to about 1.0 gram per cubic centimeter, provide a diaphragm that is high in permeability and of improved current efficiency. Diaphragms that are high in zirconia alone, e.g., above about 1.0 gram per cubic centimeter, have a permeability that is too low. Preferably, the loading of zirconia is from about 0.1 to about 1.0 gram per cubic centimeter for a mat having a porosity of about 0.70 to about 0.90.

In an exemplification of this invention where a felt matrix is utilized, the matrix may be treated with a compatible perfluorinated hydrocarbon polymer having pendant, wettability enhancing groups such as acid groups or alkaline groups, for example, sulfonic acid groups, carboxylic acid groups, sulfonamide groups, or the like. This may be accomplished by providing a solution of the fluorocarbon resin in alcohol, water, or a miscible system of alcohol and water, and thereafter evaporating off the solvent. Thereafter, the zirconia gel is formed within the matrix, that is, on the external and internal surfaces of the matrix.

The zirconium oxide gel, that is, the hydrous oxide of zirconium, may be deposited on the substrate, according to one exemplification, by forming a solution of a precursor compound, for example, zirconium oxychloride, $ZrOCl_2 \times nH_2O$, where "n" is from 2 to 10, usually from 4 to 8. This solution preferably contains up to its solubility limit of zirconium oxychloride, that is, at up to about 360 grams per liter thereof. The porous substrate is saturated with the solution after which the mat is contacted with a base. Preferably the base is a gas, for example, ammonia or anhydrous ammonia. Alternatively, the base may be a liquid as ammonium hydroxide. The base converts the zirconium oxychloride to the hydrous oxide of zirconium and forms ammonium chloride.

The precursors of the hydrous gel coatings can be deposited in various ways. For example, the solution of the precursor can be brushed or sprayed onto the porous substrate if the solution wets into the matrix. Alternatively, the porous matrix can be immersed in the solution a vacuum drawn to remove the air from the matrix, and the vacuum released to draw solution into the matrix.

After hydrolysis and formation of the ammonium chloride, the ammonium chloride may be left in the porous matrix, for example, to be leached out by the electrolyte. However, according to the method herein contemplated, the ammonium chloride is leached out, the porous matrix dehydrated, and additional oxides deposited thereon, that is, additional hydrous oxide of zirconium. In this way, hydrous oxide loadings of up to about 1.5 grams per cubic centimeter may be provided.

Leaching the ammonium chloride removes the products of hydrolysis, increases the porosity, and allows for further matrix loading of additional oxides, i.e., zirconia and magnesia. The leaching is preferably followed by dehydration, for example, thermal dehydration, vacuum dehydration, the use of desiccants, or various combinations thereof. After leaching and dehydration, additional cycles of matrix gel loading may be utilized in order to obtain the desired permeability and current efficiency. Generally, from one to five cycles are practical and preferably from about two to four cycles are utilized. If there are too many cycles of deposit, hydrolysis, leach, and dehydration, the permeability is too low, while if there are too few, that is less than about two, permeability is too high and the current efficiency is too low.

As herein contemplated the ammonium chloride may be leached out with water and thereafter the mat is partially dehydrated. The time required to dehydrate the members or mat is a function of the desired degree of dehydration, the relative humidity of the air, and the temperature. The method of this invention may be utilized with both fluorocarbon substrates and asbestos matrices.

According to a further exemplification of this invention, a hydrous oxide of magnesium may be incorporated with the hydrous oxide of zirconium, for example, by contacting, and, preferably saturating, the porous body with an aqueous solution comprising from about 1 to about 30 mole percent magnesium, basis total moles of magnesium and zirconium. The magnesium may be present in the solution as magnesium chloride, while the zirconium is present in the solution as the zirconium oxychloride described above. According to this alternative exemplification, the porous body is contacted, and, preferably saturated, with an aqueous solution of zirconium oxychloride and magnesium chloride and thereafter the porous body is contacted with ammonia whereby to hydrolyze the zirconium oxychloride and the magnesium chloride. Preferably the solution contains from about 50 to about 260 grams per liter of zirconium oxychloride and from about 0.5 to about 100 grams per liter of magnesium chloride whereby to provide a weight ratio of about 1 to 30 parts of magnesium to about 100 parts total magnesium and zirconium calculated as the oxides in the solution. The porous matrix is saturated with the solution as described above and hydrolyzed with a suitable base, for example, ammonium hydroxide, anhydrous ammonia, or ammonia gas.

EXAMPLE I

A diaphragm was prepared by saturating a poly(tetrafluoroethylene) felt matrix with an aqueous solution of zirconium oxychloride, $ZrOCl_2$, contacting the felt matrix with $NH_3$ vapor, leaching the $NH_4Cl$ formed thereby, thermally dehydrating the hydrous zirconia gel, and resaturating the matrix with an aqueous solution of zirconium oxychloride, $ZrOCl_2$, and magnesium chloride, $MgCl_2$. The resaturated mat was again contacted with $NH_3$ vapor.

The matrix was a 50 mil thick DuPont ARMALON® XT-2663 poly (tetrafluoroethylene) filter felt matrix having approximately 68 to 70 percent void volume. It was treated with a solution 0.65 weight percent DuPont NAFION® 601 polymer, a perfluorinated polymer having pendant sulfonic acid groups in a solution containing equal amounts of distilled water and ethanol. The polymer was applied to the matrix by laying the mat on a flat glass plate and brushing the solution onto the matrix until the matrix was saturated. The matrix was then allowed to dry in air at 27° C. for 70 minutes followed by heating to 100° C. for 60 minutes, whereby to remove the water and ethanol solvent. The mat contained 0.96 grams of resin per square foot.

The zirconium oxychloride solution was prepared by adding PCR, Inc. 99 percent assay $ZrOCl_2 \times 4H_2O$ to water to obtain a 41 weight percent solution of $ZrOCl_2 \times 4H_2O$.

The saturation of the fibrous mat with the zirconium oxychloride solution was accomplished by submerging the mat in the solution, drawing a vacuum on the submerged mat to evacuate air from the porous mat, and releasing the vacuum to allow the solution to penetrate and fill the air evacuated mat. The drawing and releasing of the vacuum was repeated until there was no further uptake of solution.

The mat was then contacted with $NH_3$ vapor for 18 hours to hydrolyze the chloride leached in water at room temperature for 72 hours and dried at 50° C. for one hour.

A magnesium chloride solution was prepared by dissolving 1.67 parts by weight of $MgCl_2 \times 6H_2O$ in one part by weight of distilled water. A solution containing 1.7 moles per liter of $ZrOCl_2$ and 0.5 moles per liter of $MgCl_2$ was prepared by mixing seven parts of the $ZrOCl_2$ solution, previously prepared, with one part of the $MgCl_2$ solution.

The treated and dehydrated matrix was saturated with the mixed $ZrOCl_2$-$MgCl_2$ solution by brush application.

The mat was then contacted with $NH_3$ vapor for 18 hours to hydrolyze the chlorides and stored in brine.

Thereafter, the mat was tested as a diaphragm in a laboratory diaphragm cell. With a 0.16 inch (4.1 millimeter) anode to cathode gap, a ruthenium dioxide coated titanium mesh anode and a perforated steel plate cathode, the head was 23 to 31 inches, the average cell voltage was 3.15 volts at a current density of 190 Amperes per square foot, and the cathode current efficiency was 93 percent.

EXAMPLE II

A diaphragm was prepared by saturating a poly(tetrafluoroethylene) felt matrix with an aqueous solution of zirconium oxychloride, $ZrOCl_2$, contacting the matrix with $NH_3$ vapor, leaching the $NH_4Cl$ formed thereby, thermally dehydrating the hydrous zirconia gel, and resaturating the matrix with an aqueous solution of zirconium oxychloride, $ZrOCl_2$, and magnesium chloride, $MgCl_2$. The resaturated mat was again contacted with $NH_3$ vapor.

The mat was a 50 mil thick DuPont ARMALON® XT-2663 poly(tetrafluoroethylene) filter felt mat having approximately 68 to 70 percent void volume.

The zirconium oxychloride solution was prepared by adding PCR, Inc. 99 percent assay $ZrOCl_2 \times 4H_2O$ to water to obtain a 41 weight percent solution of $ZrOCl_2 \times 4H_2O$.

The saturation of the fibrous mat with the zirconium oxychloride solution was accomplished by submerging the mat in the solution, drawing a vacuum on the submerged mat to evacuate air from the porous mat, and releasing the vacuum to allow the solution to penetrate and fill the air evacuated mat. The drawing and releasing of the vacuum was repeated until there was no further uptake of solution.

The mat was then contacted with $NH_3$ vapor for 18 hours to hydrolyze the chloride, leached in water at 50° C. for 1½ hours and dried at 50° C. for one hour. The once treated and dehydrated mat was then given two additional cycles of resaturation with the $ZrOCl_2$ by a brush application, followed by hydrolysis, leaching, and heating in the manner described for the initial treatment cycle.

A magnesium chloride solution was prepared by dissolving 1.67 parts by weight of $MgCl_2 \times 6H_2O$ in one part by weight of distilled water. A solution containing 1.7 moles per liter of $ZrOCl_2$ and 0.5 moles per liter of $MgCl_2$ was prepared by mixing seven parts of the $ZrOCl_2$ solution with one part $MgCl_2$ solution.

The thrice treated and dehydrated mat was saturated with the mixed $ZrOCl_2$-$MgCl_2$ solution by a brush application.

The mat was then contacted with $NH_3$ vapor for 18 hours to hydrolyze the chlorides and stored in brine.

Thereafter the mat was tested as a diaphragm in a laboratory diaphragm cell. With a 0.16 inch (4.1 millimeter) anode to cathode gap, a ruthenium dioxide coated titanium mesh anode and a perforated steel plate cathode, the head was 11 to 15 inches, the average cell voltage was 3.21 volts at a current density of 190 Amperes per square foot, and the cathode current efficiency was 88 to 90 percent.

EXAMPLE III

A diaphragm was prepared by saturating a poly(tetrafluoroethylene) felt matrix with an aqueous solution of zirconium oxychloride, $ZrOCl_2$, contacting the felt matrix mat with $NH_3$ vapor, leaching the $NH_4Cl$ formed thereby, thermally dehydrating the aqueous zirconia gel, and resaturating the matrix with an aqueous solution of zirconium oxychloride, $ZrOCl_2$, and magnesium chloride, $MgCl_2$. The resaturated mat was again contacted with $NH_3$ vapor.

The mat was a 50 mil thick DuPont ARMALON® XT-2663 poly(tetrafluoroethylene) filter felt matrix having approximately 68 to 70 percent void volume. It was treated with a solution 0.65 weight percent DuPont NAFION® 601 polymer, a perfluorinated polymer having pendant sulfonic acid groups in a solution containing equal amounts of distilled water and ethanol. The polymer was applied to the matrix by laying the matrix on a flat glass plate and brushing the solution onto the matrix until the matrix was saturated. The matrix was allowed to dry in air at 27° C. for 70 minutes followed by heating to 100° C. for 60 minutes, whereby to remove the water and ethanol solvent. The mat contained 0.96 grams of resin per square foot.

The zirconium oxychloride solution was prepared by adding PCR, Inc. 99 percent assay $ZrOCl_2 \times 4H_2O$ to water to obtain a 41 weight percent solution of $ZrOCl_2 \times 4H_2O$.

The saturation of the fibrous mat with the zirconium oxychloride solution was accomplished by submerging the mat in the solution, drawing a vacuum on the submerged mat to evacuate air from the porous mat, and releasing the vacuum to allow the solution to penetrate and fill the air evacuated mat. The drawing and releasing of the vacuum was repeated until there was no further uptake of solution.

The mat was then contacted with $NH_3$ vapor for 18 hours to hydrolyze the chloride, leached in water 50° C. for 1½ hours, and dried at 50° C. for one hour. The once treated and dehydrated mat was then given two additional cycles of resaturation with $ZrOCl_2$ by a brush application, followed by hydrolysis, leaching, and heating in the manner described for the initial cycle.

A magnesium chloride solution was prepared by dissolving 1.67 parts by weight of $MgCl_2 \times 6H_2O$ in one part by weight of distilled water. A solution containing 1.7 moles per liter of $ZrOCl_2$ and 0.5 moles per liter of $MgCl_2$ was prepared by mixing seven parts of the $ZrOCl_2$ solution of one part of the $MgCl_2$ solution.

The thrice treated and dehydrated matrix was saturated with the mixed $ZrOCl_2$-$MgCl_2$ solution by a brush application.

The mat was then contacted with $NH_3$ vapor for 18 hours to hydrolyze the chlorides and stored in brine.

Thereafter, the mat was tested as a diaphragm in a laboratory diaphragm cell. With a 0.16 inch (4.1 millimeter) anode to cathode gap, a ruthenium dioxide coated titanium mesh anode, and a perforated steel plate cathode, the head was 47 to 55 inches, the average cell voltage was 3.16 volts at a current density of 190 Amperes per square foot, and the cathode current efficiency was 86 to 88 percent.

While the invention has been described with reference to specific exemplifications and embodiments thereof, the invention is not limited except as in the claims appended hereto.

I claim:

1. In a method of preparing a diaphragm by contacting a porous matrix with zirconium oxychloride and thereafter with an ammonium compound whereby to hydrolyze the zirconium oxychloride to form a substantially insoluble hydrous oxide of zirconium, the improvement comprising leaching out the ammonium chloride and thereafter contacting the porous matrix with additional zirconium oxychloride whereby to deposit additional hydrous oxide of zirconium in the matrix.

2. The method of claim 1 comprising leaching out the ammonium chloride with water and thereafter dehydrating the matrix.

3. The method of claim 2 comprising dehydrating the matrix to a substantially constant weight.

4. The method of claim 1 comprising sequentially depositing at least about 0.1 gram per cubic centimeter of a hydrous oxide of zirconium calculated as zirconium oxide in said porous matrix.

5. The method of claim 1 comprising codepositing magnesium oxide and zirconium oxide in the porous matrix.

6. The method of claim 1 wherein the porous matrix is asbestos.

7. The method of claim 1 wherein the porous matrix is a fluorocarbon.

* * * * *